United States Patent [19]

Landry, Jr.

[11] Patent Number: 4,486,120

[45] Date of Patent: Dec. 4, 1984

[54] SPREADER BAR FOR SOIL EROSION PREVENTION MATS

[76] Inventor: Kossuth J. Landry, Jr., P.O. Box 599, Channelview, Tex. 77530

[21] Appl. No.: 210,328

[22] Filed: Nov. 25, 1980

[51] Int. Cl.[3] ..... E02B 3/12; B66C 1/66

[52] U.S. Cl. ..... 405/17; 294/81 SF

[58] Field of Search ..... 405/15, 16, 17, 19, 405/20, 258; 294/66 R, 81 SF

[56] References Cited

U.S. PATENT DOCUMENTS

| | | | |
|---|---|---|---|
| 3,148,909 | 9/1964 | Tantlinger | 294/81 SF |
| 3,151,904 | 10/1964 | Tantlinger et al. | 294/81 SF |
| 3,262,729 | 7/1966 | Willison et al. | 294/81 SF |
| 4,201,494 | 5/1980 | Crowe | 405/17 |
| 4,258,949 | 3/1981 | Keagbine | 294/81 SF |
| 4,372,597 | 2/1983 | Stillman et al. | 294/81 SF X |

*Primary Examiner*—David H. Corbin

*Attorney, Agent, or Firm*—Guy E. Matthews

[57] ABSTRACT

The invention relates to a spreader bar for picking up and laying down soil erosion prevention mats formed by connecting a matrix of soil erosion preventing blocks with cable or the like through passageways therein.

1 Claim, 5 Drawing Figures

SPREADER BAR FOR SOIL EROSION PREVENTION MATS

This invention relates generally to a spreader bar for picking up and laying soil erosion prevention mats. More particularly, the invention relates to a spreader bar having hinged hook carrying ends for engaging a soil erosion prevention mat formed by connecting a matrix of concrete soil erosion prevention blocks with cable or the like through passageways in the blocks, such as the soil erosion prevention blocks disclosed in my U.S. Pat. No. 4,227,829, and my co-pending patent application entitled Soil Erosion Prevention Block Insert and Apparatus for Positioning, Ser. No. 204,055, filed Nov. 4, 1980, which are hereby incorporated by reference herein.

Matrices of soil erosion prevention blocks are known in the art, as shown by my above-identified United States patent and application. In the prior art, soil erosion prevention blocks or other revetment structures were positioned one adjacent another to form a matrix of such structures on the embankment or inclined area to be protected from erosion. U.S. Pat. No. 3,597,928, Pilaar discloses a matrix of soil erosion prevention blocks adhered to a porous flexible mat, which is apparently placed on an inclined area to control erosion. A problem inherent in that construction is that a border of mat must extend out from the blocks a sufficient distance to permit the mat to be gripped so that the matrix can be moved. When matrices of blocks are laid, the border prevents positioning the blocks on neighboring mats adjacent one another.

A problem in the prior art above described is the speed and ease with which the blocks or mats may be positioned on the inclined area to be protected. The blocks either have to be positioned one at a time adjacent one another at the job site or in the case of Pilaar, the number of blocks formed in the matrix is substantially limited by the strength of the mat they are adhered to. Further, in the latter case, an apparatus for laying such mats is known which comprises a frame having ends for clamping the mat border. The apparatus includes rubber covered bars between which the mat is clamped for lifting the matrix. Naturally, the size of such matrix which may be picked up and laid is substantially limited by the clamping force and contact area between the bars and mats surface.

SUMMARY OF THE INVENTION

The present invention is directed to a spreader bar for picking up and laying a very large matrix of cable connected soil erosion prevention blocks. The invention is more particularly directed to a spreader bar for use with mats having loops of cable or the like at the ends thereof for lifting and laying the mat; such as a soil erosion prevention block mat in accordance with my U.S. Pat. No. 4,227,829. The block matrix disclosed therein has the two cables through the blocks connected together at the ends thereof to form loops for lifting the blocks.

The spreader bar of the invention includes hinged cable carriers at the ends thereof for engaging the ends of the mat. The loops are engaged by hooks at each end of the spreader bar fixed to a shaft rotatably mounted with the cable carrier. The hooks are thus rotatable from a retracted position in which the carrier is positioned adjacent the end of the mat to an engaged position where the hooks engage the loops of the mat's end, securely attaching it to the cable carrier. The mat may then be picked up with the spreader bar and laid down in the desired position adjacent other mats on the area to be protected from erosion. The spreader bar of the invention is particularly useful for laying soil erosion prevention mats where the mat must be released under water, such as at a shoreline, as the hooks are simultaneously released from the loops by the cable carrier of the invention.

Because the soil erosion prevention blocks are connected together by continuous cables, a large number of such blocks may be laid at one time, with the only limitations as to the size of the mat picked up being the strength of the cable therethrough or the lifting capacity of the spreader bar or lifting means.

It is therefore an object of the present invention to provide a new and improved spreader bar for picking up and laying down end-to-end and side-to-side large expanses of soil erosion prevention mat in a short amount of time and with a minimum of effort.

DETAILED DESCRIPTION OF THE PREFERRED EMBODIMENT

Figure 1:
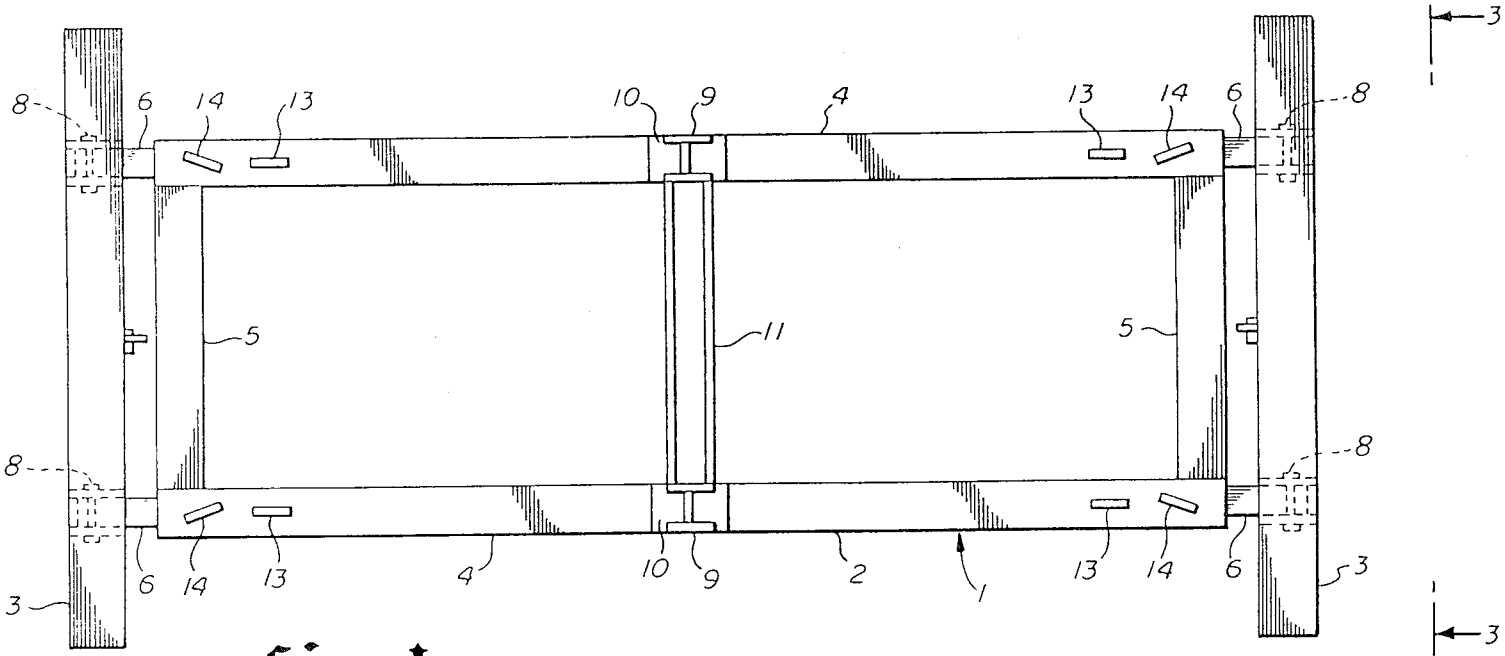
FIG. 1 is a top view of the spreader bar of the invention.
Figure 2:
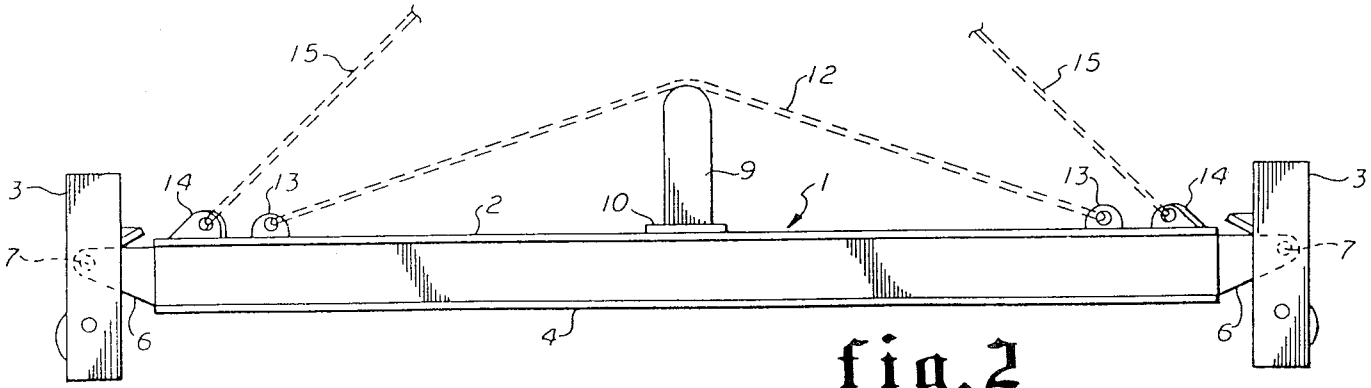
FIG. 2 is a side view of the spreader bar of the invention.

Referring now to the drawings, the spreader bar of the invention is indicated generally at 1 in FIGS. 1 and 2. The spreader bar comprises generally a frame 2 having two hinged cable carriers 3 mounted with the ends thereof. The frame may be constructed of steel I-beam, tube, or other material for strength depending upon the weight of the mat to be lifted, and includes two extended main beams 4. A number of cross beams 5 are provided fixed between the main beams 4, preferably by welding, to form a strong and rigid structure.

The frame further includes four frame extension plates 6 which are welded or otherwise fixed to the main beams 4. The ends of the frame extension plates have holes drilled therethrough for receiving the cable carrier hinge pins 8, as will be described later.

Two stanchions 9 are fixed to stanchion plates 10, which are likewise fixed, by welding or bolting to the main beams 4 of the frame. A cross member 11 is provided fixed between the stanchions to strengthen them under loaded conditions.

As best seen in FIG. 2, the stanchions cooperate with stanchion cables 12 to minimize bending of the frame when soil erosion prevention mats are lifted. The stanchion cables 12 are situated over the stanchions 9 and attached at either end to pad-eyes 13 welded to the main beams 4 of the frame. A number of lifting pad-eyes 14 are also provided fixed to the frame for lifting the spreader bar. It will be appreciated that when a lifting force is applied to the lifting cables 15 to raise the spreader bar, the weight of the mat attached to the cable carriers 3 will exert a force through the hinge pins 8 to the frame. This force creates a bending moment which tends to cause the main beams 4 to bend upwardly concave. The stanchion cables 12, being tightly connected to the pad-eyes 13 over the stanchions 9 thus exert a downward force on the main beams 4 at the stanchions and an upward force on the main beams at the pad-eyes 13 to counter the bending moment and minimize bending of the frame.

Figure 4:
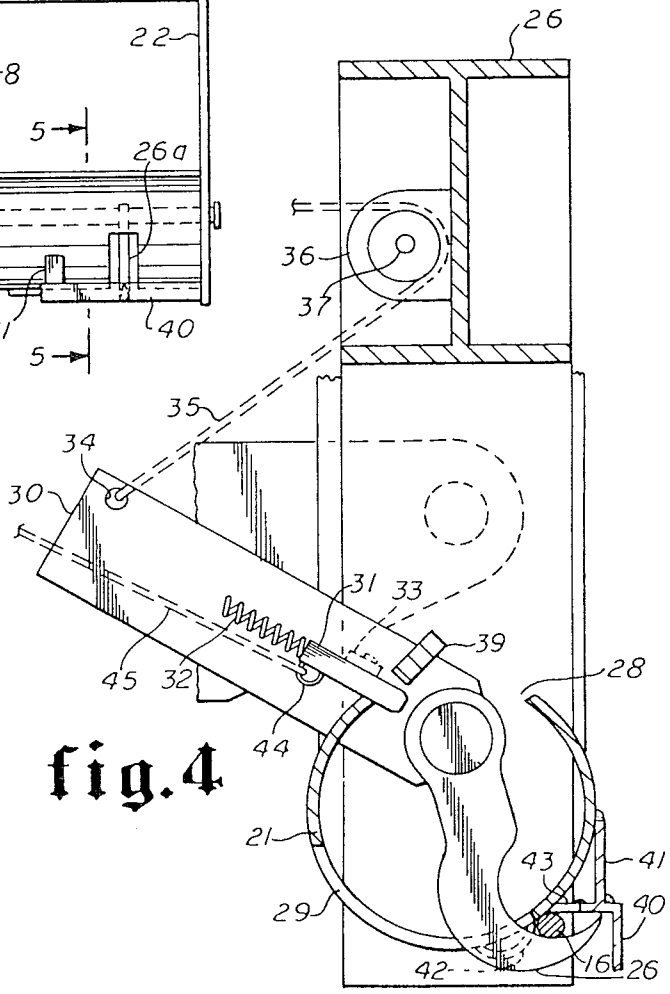
FIG. 4 is a view of the latch of the invention along lines 4—4 of FIG. 3.
Figure 3:
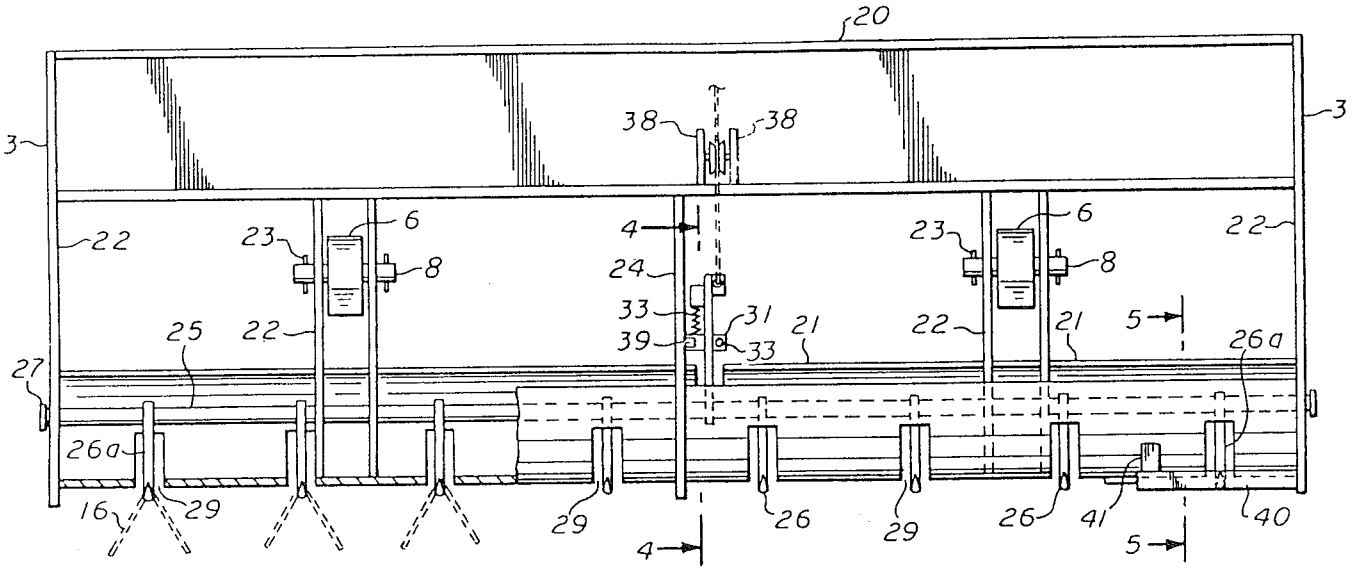
FIG. 3 is a view of the spreader bar of the invention along lines 3—3 of FIG. 1.
Figure 5:
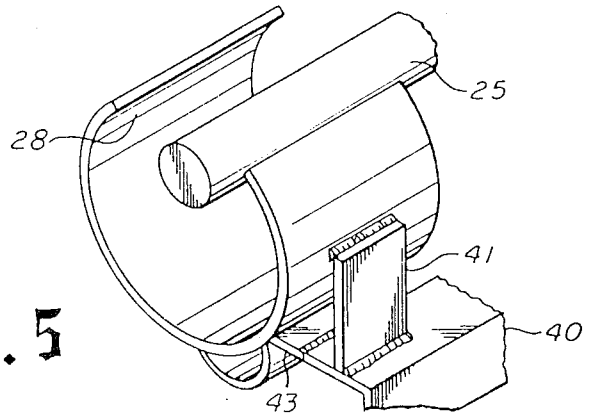
FIG. 5 is an isometric section through the cable carrier of the invention along lines 5—5 of FIG. 3.

Referring now to FIGS. 3–5, the self stripping cable carrier 3 of the invention is illustrated. The cable carrier engages or releases the ends of the soil erosion prevention mat as desired by means of a plurality of hooks for engaging the loops 16 at the ends of the mat. Naturally, the width and design strength of the cable carrier may be varied according to the width and weight of mat to be lifted. The cable carrier includes from one to as many number of hooks needed to engage the cable loops of the mat, which will depend upon the width of the blocks of the mat and the positioning of the cables through the blocks.

The cable carrier comprises generally an upper beam 20 and a lower beam 21. A number of support plates 22 and a center support plate 24 are provided preferably welded between the upper beam 20 and the lower beam 21. Four of the support plates 22 are located so as to bracket the two frame extensions 6, and have openings formed therethrough for receiving the cable carrier hinge pins 8. The hinge pins 8 preferably include cotter pins 23 or the like therethrough to retain the pin 8 in the hinge assembly.

The support plates 22, 24 have openings therethrough for receiving a shaft 25, rotationally mounted with the support plates. Hooks 26 which may be standard cable hooks are fixed to the shaft, such as by welding, for engaging the cables of the mat. Stops 27 or the like, such as cotter pins, are provided mounted at the shaft ends to prevent lateral movement of the shaft with respect to the support plates.

In the preferred embodiment the outermost hooks **26*a* are offset outwardly on the shaft, as best seen in FIG. 3, while the rest of the hooks 26 are uniformly spaced apart. The hooks 26 are thus positioned to engage the mat cables at the approximate centerline of each row of blocks, thereby keeping the mat ends generally parallel to the plane of the hooks. By disposing the outer hooks 26*a* laterally outwardly, any tendency of the outer rows of blocks to tilt downwardly at their outer edges is counter-acted and the mat is more easily laid down, as the outer edges of the mat are maintained generally flatter which simplifies laying a mat adjacent another mat and are prevented from digging into the surface of the area to be covered with the mat. It has been found that an offset of 2 inches for the outer hooks are sufficient for this purpose when twelve inch square blocks are employed and the uniform spacing of the other hooks 26** is twelve inches.

The shaft 25 is preferably mounted through the support plates 22 and hooks 26 before the hooks are fixed to the shaft or the lower beam 21 is fixed to the support plates. As best seen in FIGS. 4 and 5, the lower beam 21 is preferably tubular so that the cables 16 when under load as the mat is lifted bear against the rounded surface of the lower beam 21. The lower beam 21 may be fabricated from standard steel tube stock and preferably has a longitudinally extended opening or slot formed therein to permit assembly of the lower beam around the shaft. The lower beam further includes a plurality of slots or openings 29 therethrough for permitting the hooks 26 to extend and move outwardly from the lower beam. The openings 28, 29 permit the lower beam 21 to be mounted around the shaft and welded to the support plates to complete the major assembly of the cable carrier 3.

An arm 30 is provided welded or otherwise fixed to the shaft 25 to permit rotation of the shaft to engage or disengage the cables. The cable carrier 3 preferably also includes a latch mechanism to safely lock the hooks in the cable engaging position. The latch mechanism comprises a latch bar 31 pivotally mounted with the arm in any suitable manner, such as by a latch bolt 33 through an opening in the arm, threadably engaged to the arm 30. The mechanism preferably includes a spring 32 urging the latch bar downwardly wherein it is behind a latch lug 39 fixed to the center support plate 24 to prevent rotation of the arm 30 and shaft 25 to the nonengaged position. The mechanism is released by pivoting the latch bar 31 upwardly until it clears the latch lug 39 and allows the shaft 25 to be rotated. The latch preferably includes an eye 44 fixed to the latch bar 31, to which a latch release cable 45 is attached. Simultaneously pulling the latch release cables 45 permits the mat ends to be simultaneously released.

To assist in disengaging the hooks 26 from the mat cables, a release cable 35 may be provided fixed to the arm 30 such as at opening 34 by any suitable means. The cable 35 is mounted around a pulley 36 which is rotatably mounted to the upper beam by means of pillow blocks 38 fixed to the upper beam and a shaft 37. With such a cable and pulley arrangement on both ends of the spreader bar, the hooks 26 are simultaneously disengagable from the mat cables by pulling the latch cable 35, such as with a winch (not shown). Cables for rotating the hooks and shaft may be provided if desired similarly mounted to the arm 30, however in that case no pulley is required as the arms 30 are moved inwardly of the cable carriers 3 to rotate the hooks to engage the cable.

The cable carrier also preferably includes a hook guard 40 welded or otherwise fixed to a lower beam 21. The hook guard 40 closes the end of the hook 26 when the cable carrier is in the engaged position, thereby securely enclosing the mat cable. The hook guard 40 may be fabricated from a continuous angle iron or the like. A plurality of guard braces 41, 43 fixed to the hook guard 40 and the lower beam 21 strengthen and position the hook guard 40 so that the end of the hook is safely enclosed.

A plurality of stripper ridges 42 are provided fixed to the lower beam adjacent the hooks 46. As best seen in FIG. 4, the stripper ridges aid in disengaging the mat cables from the hooks 26 by causing the mat cable to ride outwardly from the shaft and off of the hook 26. The stripper ridges are perferably formed from half round tubing and are welded on either side of and adjacent the hooks 26.

In operation of the spreader bar of the invention, the arm 30 is moved, rotating the shaft and hooks into the disengaged position. The spreader bar is then lifted, as described previously, by a crane or otherwise and situated over the soil erosion prevention mat to be moved. It should be noted that it is preferable that the frame length, as measured between the hinge pin 8 centers, be approximately 1½ feet longer than the mat, where the mat cables form loops extending 11 to 13 inches from the edge of the mat. For lifting other mats, it is preferable that the frame be sized such that the cable carriers when positioned over the mat cables are located so that the hooks are over the mat cable loops and when rotated, they engage the mat cables. When the cable carriers are thus positioned over the mat, the arm 30 is rotated inwardly and downwardly to rotate the hooks and engage the cable loops until the latch bar 31 can pivot behind the center support plate 24 to lock the cables between the hooks 26 and hook guard 40. If necessary, the cable covers may be rotated to permit the hooks 26 to engage the mat cables. The spreader bar may then be lifted.

The mat when lifted assumes a concave configuration, causing the cable carriers to rotate inwardly. The spreader bar and mat may then be positioned with the crane where desired and the spreader bar lowered. As the mat is laid down, the cable carriers will return to their original position. The hook guard 40 effectively locks the mat cables onto the hooks until the mat is desired to be released. To release the mat, the latch bar 31 is pivoted upwardly until it is disengaged from the center support bar 24 and the arm rotated. Rotation may be accomplished manually or by means of a winch or like device as discussed previously however, it has been found that in most cases the weight of the hooks will rotate the shaft 25 until the cables 16 are disengaged. The stripper ridge is important in disengaging the hooks 26 from the mat cables, in that as the hook is rotated, the mat cable rides outwardly over the stripper ridge and off of the hook 26.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A spreader bar for lifting and laying a matrix of soil erosion prevention blocks, said matrix including two cables disposed through said blocks and being connected together at the ends thereof to form loops for lifting said blocks, said spreader bar comprising:

a. a frame including (1) two extended main beams, (2) a plurality of cross beams fixed between said main beams, (3) a plurality of frame extension plates affixed to the ends of said main beams, and (4) a plurality of stanchions having stanchion plates affixed to said main beams, said stanchions cooperating with stanchion cables to minimize bending of said frame when said soil erosion prevention blocks are lifted, said stanchion cables being situated over said stanchions and being attached at either end to a plurality of lifting pad eyes welded to said main beams of said frame for lifting said spreader bar;

b. at least one hinged cable carrier mounted to said frame, said cable carrier comprising: (1) an upper beam and a lower beam, (2) a plurality of apertured support plates attached between said upper and lower beams for receiving therethrough cable carrier hinge pins and a rotationally mounted shaft having at least one standard cable hook affixed thereto for engaging said cable of said matrix of soil erosion prevention blocks, said shaft being mounted through said support plates, (3) an arm affixed to said shaft so as to permit rotation of said shaft for engagement or disengagement of said cables, (4) a latch mechanism for locking said hook in cable engaging position having a latch bar pivotally mounted with said arm, said mechanism also including a spring to urge said latch bar downwardly behind a latch lug to prevent rotation of said arm and said shaft to the nonengaged position, (5) a hook guard affixed to said lower beam for closing the end of said hook when said cable carrier is in engaged position, and (6) at least one stripper ridge affixed to said lower beam adjacent said hook to aid in disengaging said matrix cable from said hook by causing said matrix cable to ride outwardly from said shaft and off of said hook.

* * * * *